US009536636B2

(12) United States Patent
Ikeda et al.

(10) Patent No.: US 9,536,636 B2
(45) Date of Patent: Jan. 3, 2017

(54) INSULATED WIRE, COIL, AND ELECTRIC/ELECTRONIC EQUIPMENTS AS WELL AS METHOD OF PRODUCING A FILM DELAMINATION-RESISTANT INSULATED WIRE

(71) Applicants: FURUKAWA ELECTRIC CO., LTD., Tokyo (JP); FURUKAWA MAGNET WIRE CO., LTD., Tokyo (JP)

(72) Inventors: Keisuke Ikeda, Tokyo (JP); Makoto Oya, Tokyo (JP); Hideo Fukuda, Tokyo (JP); Keiichi Tomizawa, Tokyo (JP)

(73) Assignees: FURUKAWA ELECTRIC CO., LTD., Tokyo (JP); FURUKAWA MAGNET WIRE CO., LTD., Tokyo (JP)

( * ) Notice: Subject to any disclaimer, the term of this patent is extended or adjusted under 35 U.S.C. 154(b) by 0 days.

(21) Appl. No.: 15/192,195

(22) Filed: Jun. 24, 2016

(65) Prior Publication Data

US 2016/0307663 A1 Oct. 20, 2016

Related U.S. Application Data

(63) Continuation of application No. PCT/JP2014/083364, filed on Dec. 17, 2014.

(30) Foreign Application Priority Data

Dec. 26, 2013 (JP) ..... 2013-270576

(51) Int. Cl.
*H01B 3/30* (2006.01)
*H01B 13/06* (2006.01)
(Continued)

(52) U.S. Cl.
CPC ..... *H01B 3/306* (2013.01); *H01B 3/308* (2013.01); *H01B 3/421* (2013.01); *H01B 3/427* (2013.01); *H01B 13/065* (2013.01); *H01F 27/32* (2013.01)

(58) Field of Classification Search
USPC ..... 174/128.1, 119 C, 110 SR, 110 R
See application file for complete search history.

(56) References Cited

U.S. PATENT DOCUMENTS 8,686,291 B2 * 4/2014 Kikuchi ..... C09D 179/08 174/110 N
9,355,755 B2 * 5/2016 Gundel ..... H01B 7/0838
(Continued)

FOREIGN PATENT DOCUMENTS

JP 59-040409 A 3/1984
JP 63-195913 A 8/1988
(Continued)

OTHER PUBLICATIONS

International Search Report (PCT/ISA/210) issued in PCT/JP2014/083364, mailed on Mar. 24, 2015.
(Continued)

*Primary Examiner* — William H Mayo, III
*Assistant Examiner* — Krystal Robinson
(74) *Attorney, Agent, or Firm* — Birch, Stewart, Kolasch & Birch, LLP

(57) ABSTRACT

An insulated wire including a laminated resin-coated insulated wire containing: a thermosetting resin layer (A) directly or via an insulating layer (D) on a conductor having a rectangular cross-section; and at least a thermoplastic resin layer (B) on the outer periphery of the thermosetting resin layer (A), in which the cross-sectional shape of the thermosetting resin layer (A) composed of two pairs of two sides facing each other, and has at least four convex portions each of which has a film thickness in maximum, at least one convex portion of the at least four convex portions is on each of the four sides, or at least two convex portions of the at least four convex portions are at least on each of the two
(Continued)

sides facing each other, and in the each side having the convex portion, provided that a minimum film thickness is designated as "a" pm, and an average of maximum film thicknesses of the convex portions is designated as "b" pm, the a/b ratio is 0.60 or more and 0.90 or less; a coil, and electric/electronic equipment.

12 Claims, 5 Drawing Sheets

(51) Int. Cl.
*H01F 27/32* (2006.01)
*H01B 3/42* (2006.01)

(56) References Cited

U.S. PATENT DOCUMENTS

2004/0256139 A1* 12/2004 Clark ..... H01B 11/002 174/110 R
2005/0211461 A1* 9/2005 Horikoshi ..... C25D 5/10 174/117 FF
2006/0137899 A1* 6/2006 Schafer ..... H01B 3/30 174/128.1
2009/0202831 A1* 8/2009 Honda ..... C08G 73/1042 428/383
2013/0037304 A1 2/2013 Ikeda et al.

FOREIGN PATENT DOCUMENTS

JP 2012-022838 A 2/2012
JP 2012-090441 A 5/2012
JP 2013-041700 A 2/2013

OTHER PUBLICATIONS

Written Opinion (PCT/ISA/237) issued in PCT/JP2014/083364, mailed on Mar. 24, 2015.

* cited by examiner

INSULATED WIRE, COIL, AND ELECTRIC/ELECTRONIC EQUIPMENTS AS WELL AS METHOD OF PRODUCING A FILM DELAMINATION-RESISTANT INSULATED WIRE

CROSS-REFERENCE TO RELATED APPLICATIONS

This application is a continuation of PCT/JP2014/083364 filed on Dec. 17, 2014 which claims benefit of Japanese Patent Application No. 2013-270576 filed on Dec. 26, 2013, the subject matters of which are incorporated herein by reference in their entirety.

TECHNICAL FIELD

The present invention relates to an insulated wire, a coil, and electric/electronic equipments as well as a method of manufacturing a film delamination-resistant insulated wire.

BACKGROUND ART

Inverters have been installed in many types of electric equipment, as an efficient variable-speed control unit. Inverters are switched at a frequency of several kHz to tens of kHz, to cause a surge voltage at every pulse thereof. Inverter surge is a phenomenon in which reflection occurs at a breakpoint of impedance, for example, at a starting end, a termination end, or the like of a connected wire in the propagation system, and as a result, a voltage up to twice as high as the inverter output voltage is applied. In particular, an output pulse occurred due to a high-speed switching device, such as an IGBT (Insulated Gate Bipolar Transistor), is high in steep voltage rise. Accordingly, even if a connection cable is short, the surge voltage is high, and further voltage decay due to the connection cable is low. As a result, a voltage almost twice as high as the inverter output voltage occurs.

As coils for electric equipment such as inverter-related equipment, for example, high-speed switching devices, inverter motors and transformers, insulated wires, which are enameled wires, are mainly used as magnet wires in the coils. Accordingly, as described above, a voltage nearly twice as high as the inverter output voltage is applied in the inverter-related equipment. Then, it has been required in the insulated wires to minimize partial discharge deterioration, which is attributable to inverter surge.

In general, partial discharge deterioration means a phenomenon in which the following deteriorations of the electric insulating material occur in a complicated manner: molecular chain breakage deterioration caused by collision with charged particles that have been generated by partial discharge; sputtering deterioration; thermal fusion or thermal decomposition deterioration caused by local temperature rise; or chemical deterioration caused by ozone generated due to discharge, and the like. Due to the phenomenon, the electric insulating materials which actually have been deteriorated by partial discharge show reduction in the thickness.

It has been thought that inverter surge deterioration of an insulated wire also proceeds by the same mechanism as in the case of general partial discharge deterioration. Namely, partial discharge occurs in the insulated wire due to the surge voltage with a high peak value, which is occurred at the inverter, and the coating of the insulated wire causes partial discharge deterioration as a result of the partial discharge; in other words, high-frequency partial discharge deterioration.

In order to prevent deterioration of the insulated wire due to such partial discharge, a study on the insulated wire exhibiting a high-inception voltage of the partial discharge have been conducted. In order to obtain the foregoing insulated wire, there is a method of thickening an insulating layer of the insulated wire.

Further, aside from enhancing an inception voltage of the partial discharge by a coated resin layer provided on the outside of the enamel wire, an attempt to seek high-value-added properties by using a newly created coated resin layer has been conducted. For example, Patent Literatures 1 and 2 or the like propose to set an extrusion-coated resin layer on an enamel-baked layer.

On the other hand, in a rotary electric machine such as a motor, for storage of a coil obtained by subjecting an insulated wire to a winding work, in order to improve the proportion (occupancy) of the conductor of the coil to the volume space of the slot for storage, in consideration of both a fluidity of the resin varnish and a surface tension, Patent Literature 3 proposes to set a thermoplastic coated resin layer each of which side has an excurved shape as an outermost layer, on a rectangular conductor.

CITATION LIST

Patent Literatures

Patent Literature 1: JP-A-59-040409
Patent Literature 2: JP-A-63-195913
Patent Literature 3: JP-A-2012-90441

SUMMARY OF INVENTION

Technical Problem

However, by the conventional techniques described in those literatures, it was difficult to balance improvement in a partial discharge inception voltage and an adhesion property between the conductor and the enamel-baked layer. Further, in particular, at a working step in which an insulated wire is manufactured into a coil, many times wires ground against each other at a high speed. Accordingly, there was such a problem in the insulated wire having low abrasion resistance and low adhesion property that a film on a conductor is sometimes delaminated at the working step.

The present invention is contemplated for providing an inverter surge-resistant insulated wire, which is excellent in working suitability whereby a film delamination can be prevented at the working step in which an insulated wire is manufactured into a coil, and also has realized a film of the insulated layer having an adequate thickness whereby an inception voltage of the partial discharge can be increased without lowering adhesion strength between a conductor of the insulated wire and an enamel-baked layer.

Further, the present invention aims to provide a method of producing a film delamination-resistant insulated wire which prevents occurrence of delamination of the extrusion-coated resin layer from a conductor of the insulated wire, a coil employing the above-described insulated wire, and electric/electronic equipments employing said coil.

Solution to Problem

The present inventors have conducted intensive studies in order to solve the above problems of the prior art and, as a result thereof, have found that an inverter surge-resistant insulated wire which has solved the above problems can be obtained by constituting it so as not to uniform the film thickness of the enamel-baked layer which is a underlying film of the thickly coated wire, but to give a particular convex portion to a surface of the underlying film, and further by setting an extrusion-coated resin layer on the outside of the enamel-baked layer. Further, the present inventors have obtained knowledges about that in the case where the extrusion-coated resin layer is formed from a thermoplastic resin, especially a crystalline thermoplastic resin, adhesion strength is developed by the shape of the enamel-baked layer, even if crystallinity is increased. The present invention has been made on the basis of these knowledges.

The above-described problems were solved by the following means.

(1) An insulated wire comprising a laminated resin-coated insulated wire comprising:

a thermosetting resin layer (A) directly or via an insulating layer (D) on a conductor having a rectangular cross-section; and at least a thermoplastic resin layer (B) on the outer periphery of the thermosetting resin layer (A), wherein the cross-sectional shape of the thermosetting resin layer (A) composed of two pairs of two sides facing each other, and has at least four convex portions each of which has a film thickness in maximum, wherein at least one convex portion of the at least four convex portions is on each of the four sides, or at least two convex portions of the at least four convex portions are at least on each of the two sides facing each other, and wherein, in the each side having the convex portion, provided that a minimum film thickness is designated as "a" μm, and an average of maximum film thicknesses of the convex portions is designated as "b" μm, the a/b ratio is 0.60 or more and 0.90 or less.

(2) The insulated wire described in the item (1), wherein the cross-sectional shape of the thermosetting resin layer (A) at least has at least two of the convex portions on each of the two sides facing each other, and has one or at least two of the convex portions on each of the other two sides facing each other, and wherein, in the each side having the convex portion, provided that a minimum film thickness is designated as "a" μm, and an average of maximum film thicknesses of the convex portions is designated as "b" μm, the a/b ratio is 0.60 or more and 0.90 or less.

(3) The insulated wire described in the item (1), wherein the cross-sectional shape of the thermosetting resin layer (A) has one of the convex portions on the each of four sides.

(4) The insulated wire described in any one of the items (1) to (3), wherein, in the case of having one of the convex portions on one side, the cross-sectional shape of the thermosetting resin layer (A) has one of the convex portions in the vicinity of the center of the one side, or, in the case of having at least two of the convex portions on one side, the cross-sectional shape of the thermosetting resin layer (A) has one of the convex portions in the vicinity of each of both edges of the one side, or has one of the convex portions in the area ranging from a halfway point between the center and an edge of the one side to the edge thereof and another one of the convex portions in the area ranging from the other halfway point between the center and the other edge of the one side to the other edge.

(5) The insulated wire described in any one of the items (1) to (4), wherein, in the cross-sectional shape of the laminated resin coat, the cross-sectional outer shape of the thermoplastic resin layer (B) composed of two long sides facing each other and two short sides facing each other, and in each side, any portion of said side is the same in a total thickness of the laminated resin-coated layers up to the conductor.

(6) The insulated wire as described in any one of the above items (1) to (5), comprising an insulating layer (C) composed of a non-crystalline resin between the thermosetting resin layer (A) and the thermoplastic resin layer (B).

(7) The insulated wire as described in the item (6), wherein the non-crystalline resin is a resin selected from the group consisting of a polyetherimide, a polyethersulfone, a polyphenylsulfone, and a polyphenyleneether.

(8) The insulated wire as described in any one of the above items (1) to (7), wherein a resin constituting the thermoplastic resin layer (B) is a thermoplastic resin selected from the group consisting of a thermoplastic polyimide, a polyphenylenesulfide, a polyetheretherketone, and a modified polyetheretherketone.

(9) The insulated wire as described in any one of the above items (1) to (8), wherein a resin constituting the thermosetting resin layer (A) is a thermosetting resin selected from the group consisting of a polyimide, a polyamideimide, a thermosetting polyester, and a Class H polyester.

(10) A coil produced by processing the insulated wire described in any one of the above items (1) to (9) by winding.

(11) An electric/electronic equipment, comprising the coil as described in the above item (10).

(12) A method of producing a film delamination-resistant insulated wire composed of a laminated resin-coated insulated wire having a thermosetting resin layer (A) directly or via an insulating layer (D) on a conductor having a rectangular cross-section, and having at least a thermoplastic resin layer (B) on the outer periphery of the thermosetting resin layer (A), wherein the cross-sectional shape of the thermosetting resin layer (A) includes two pairs of two sides facing each other, and has at least four convex portions each of which has a film thickness in maximum, which comprises the step of:

forming said at least four convex portions by forming at least one convex portion on each of the four sides, or by forming at least two convex portions on each of at least the two sides facing each other to satisfy the a/b ratio of 0.60 or more and 0.90 or less, thereby preventing an occurrence of delamination of the thermoplastic resin layer (B) from the conductor of the insulated wire, provided that in the each side having the convex portion, a minimum film thickness is designated as "a" μm, and an average of maximum film thicknesses of the convex portions is designated as "b" μm.

Advantageous Effects of Invention

The insulated wire of the present invention is an insulated wire in which an insulating film has been formed by coating a conductor with a resin layer having a laminated structure of at least 2 layers having an enamel-baked layer and an extrusion-coated resin layer, which are composed of different kinds of resins from one another in terms of difference in heat resistance. The formed insulating film exhibits an excellent workability resistance to the bending work (winding work) into a coil or the like. As a result, by this insulating film, an air gap which may occur between films of at least an enamel-baked layer and an extrusion-coated resin layer at the time of bending work or the like is also eliminated.

Accordingly, the present invention enables to provide an inverter surge-resistant insulated wire, which is excellent in working suitability whereby a film delamination can be prevented at the working step into the above coil, and also to realize an insulating layer having an adequate thickness whereby the partial discharge inception voltage can be increased without lowering adhesion strength between a conductor and an enamel-baked layer of the insulated wire. Further, the present invention enables to provide a method of manufacturing a film delamination-resistant insulated wire in which an occurrence of delamination of the insulating layer has been prevented. Further, the present invention enables to provide a high-performance coil employing such insulated wire and also electric/electronic equipments employing the coil.

Other and further features and advantages of the invention will appear more fully from the following description, appropriately referring to the accompanying drawings.

BRIEF DESCRIPTION OF THE DRAWINGS

Insulated Wire

The insulated wire of the present invention is composed of a laminated resin-coated insulated wire having a thermosetting resin layer (A) (also referred to as an enamel-baked layer) directly or via an insulating layer (D) on a rectangular conductor having a cross-section whose four corners have a curvature radius r described below, and having at least a thermoplastic resin layer (B) (also referred to as an extrusion-coated resin layer) on the outer periphery of the thermosetting resin layer (A).

Figure 4:
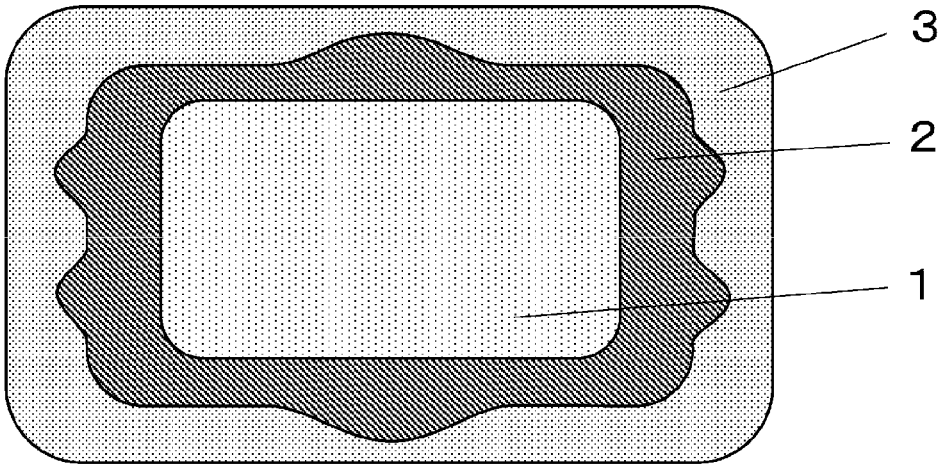
FIG. 4 is a schematic cross-sectional view of a laminated resin-coated insulated wire of the present invention having an enamel-baked layer on a rectangular conductor, in which a thick convex portion is set in the center of each of two long sides facing each other, and thick convex portions are set in the vicinity of each of both edges of each of two short sides facing each other.
Figure 5:
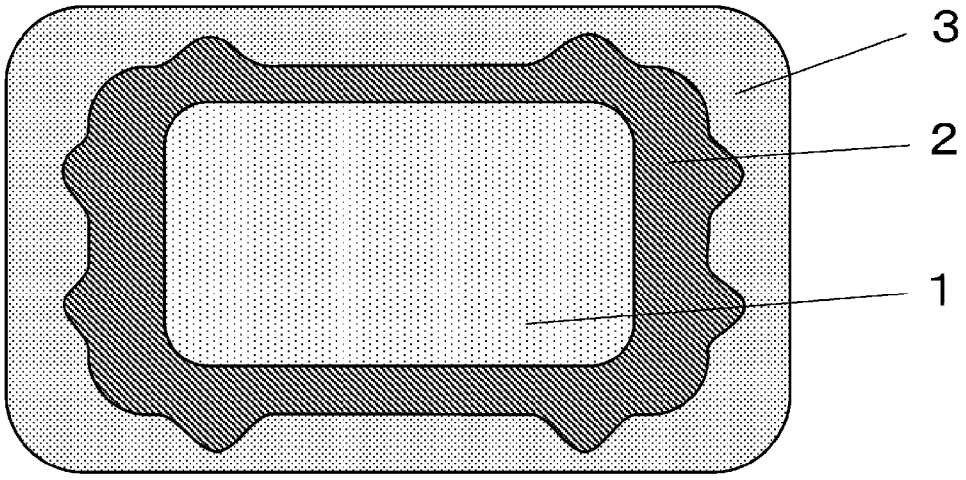
FIG. 5 is a schematic cross-sectional view of the laminated resin-coated insulated wire of the present invention having an enamel-baked layer on a rectangular conductor, in which thick convex portions are set in the vicinity of each of both edges of each side of four sides.
Figure 6:
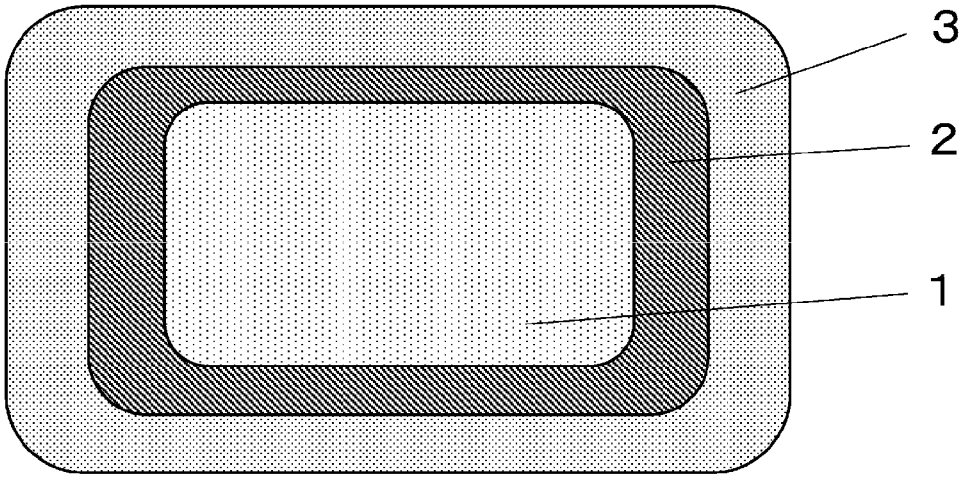
FIG. 6 is a schematic cross-sectional view of a laminated resin-coated insulated wire having a conventional cross-section-shaped enamel-baked layer on a rectangular conductor.

In the present invention, as shown in FIGS. 1 to 5, with respect to the cross-sectional shape of the laminated resin coat, the thickness of the thermosetting resin layer (A) surrounding and enclosing the conductor is not such a conventional uniform thickness as shown in FIG. 6, but a thick convex portion is set on a long side and/or a short side thereof, and a maximum thickness of the convex portion is specified by a particular range.

Note that FIGS. 1 to 9 each schematically show a laminated resin-coated layer of two layers including a thermosetting resin layer 2 (A) (enamel-baked layer) provided on a conductor 1, and a thermoplastic resin layer 3 (B) provided on the outer periphery of the thermosetting resin layer 2 (A). However, an insulating layer (D) may be set between the conductor and the thermosetting resin layer 2 (A), and an interlayer, for example, an insulating layer (C) composed of a non-crystalline resin as an adhesion layer (hereinafter, also referred to as "a non-crystalline resin layer (C)") may be set between the thermosetting resin layer 2 (A) and the thermoplastic resin layer 3 (B).

Note that in the case of having the insulating layer (D) and the interlayer, these layers shall be omitted in FIGS. 1 to 5. Further, this is also applied to FIGS. 6 to 9.

Further, these layers each may be a single layer or a multiple layers composed of two or more layers.

Hereinafter, the present invention is described in order from a conductor.

<Conductor>

As the conductor used in the present invention, use may be made of any conductor that is usually used in insulated wires and examples thereof include a metal conductor such as a copper wire and an aluminum wire. The conductor is a conductor of preferably a copper wire and more preferably a low-oxygen copper whose oxygen content is 30 ppm or less, and more preferably a low-oxygen copper whose oxygen content is 20 ppm or less or oxygen-free copper. When the conductor is melted by heat for the purpose of welding if the oxygen content is 30 ppm or less, voids caused by contained oxygen are not occurred at a welded portion, the deterioration of the electrical resistance of the welded portion can be prevented, and the strength of the welded portion can be secured.

Regarding a conductor used in the present invention, the cross-sectional shape thereof is rectangular. The rectangular conductor has higher occupancy with respect to the stator slot at the time of winding, compared to a round conductor. Accordingly, the rectangular conductor is preferably used for this purpose.

In view of suppressing a partial discharge from a corner portion, the rectangular conductor has preferably such a shape that chamfered edges (curvature radius r) are provided at four corners as shown in FIGS. 1 to 9. The curvature radius r is 0.6 mm or less and in a range from 0.2 to 0.4 mm.

The size of the cross-section of the conductor is not particularly limited, but the width (long side) thereof is preferably from 1 to 5 mm, and more preferably from 1.4 to 4.0 mm, and the thickness (short side) is preferably from 0.4 to 3.0 mm, and more preferably from 0.5 to 2.5 mm. The ratio of length of the width (long side) to the thickness (short side) is preferably from 1:1 to 4:1. Regarding a cross-section of the conductor to be used in the present invention, the width and the thickness may be equal to each other. In other words, the cross-section may be an approximate square shape. In the case that the cross-section of the conductor is an approximate square shape, the long side means each of the two sides facing each other, while the short side means each of the other two sides facing each other.

<Thermosetting Resin Layer (A)>

In the present invention, at least one thermosetting resin layer (A) composed of a thermosetting resin is provided as an enamel-baked layer.

Further in the present invention, the single layer means that even in a case where layers in which resins forming the layers and additives contained therein are the same in each of the layers, are laminated, these layers are regarded as the same layer, and on the other hand, even in a case that the layers are composed of the same resins, when compositions constituting the layers are different from one another such that, for example, a kind of additives or a compounding amount is different from one another, the number of the layers are counted.

This definition is also applied to layers other than the enamel-baked layer.

The enamel-baked layer is formed by coating and baking a resin varnish on a conductor more than once. If needed, the resin varnish may contain various kinds of additives or the like, such as an antioxidant, an antistatic agent, a ultraviolet inhibitor, a light stabilizer, a fluorescent whitening agent, a pigment, a dye, a compatibilizing agent, a lubricant, a toughening agent, a frame retardant, a cross-linking agent, a cross-link aid, a plasticizer, a thickener, a viscosity depressant, and an elastomer. As a method of coating a resin varnish, an ordinary method may be used. For example, there is a method of employing a die for coating a varnish, which is similar to the shape of the conductor. The conductor coated with the foregoing resin varnish is baked in a baking furnace also in accordance with an ordinary method. Specific baking conditions depend on the shape or the like of the furnace. However, in the case of about 5 m-natural convection type vertical furnace, the baking can be achieved by setting the transit time to the range of 10 to 90 sec at the rage of 400 to 500° C.

The resin varnish use an organic solvent and the like so as to make the thermosetting resin be a varnish, the organic solvent is not particularly limited as long as the organic solvent does not inhibit the reaction of the thermosetting resin, and examples thereof include amide-based solvents such as N-methyl-2-pyrrolidone (NMP), N,N-dimethylacetamide (DMAC), dimethyl sulfoxide, and N,N-dimethylformamide; urea-based solvents such as N,N-dimethylethyleneurea, N,N-dimethylpropyleneurea, and tetramethylurea; lactone-based solvents such as γ-butyrolactone and γ-caprolactone; carbonate-based solvents such as propylene carbonate; ketone-based solvents such as methyl ethyl ketone, methyl isobutyl ketone, and cyclohexanone; ester-based solvents such as ethyl acetate, n-butyl acetate, butyl cellosolve acetate, butyl carbitol acetate, ethyl cellosolve acetate, and ethyl carbitol acetate; glyme-based solvents such as diglyme, triglyme, and tetraglyme; hydrocarbon-based solvents such as toluene, xylene, and cyclohexane; and sulfone-based solvents such as sulfolane.

Among these, in view of high solubility, high reaction promotion properties or the like, an amide-series solvent or a urea-series solvent is preferred; and in view of having no hydrogen atom that is apt to inhibit a crosslinking reaction due to heating or the like, N-methyl-2-pyrrolidone, N,N-dimethylacetamide, N,N-dimethylethyleneurea, N,N-dimethylpropyleneurea or tetramethylurea is further preferred, and N-methyl-2-pyrrolidone is particularly preferred.

Note that the enamel-baked layer of the thermosetting resin layer (A) may be set directly on the outer periphery of the conductor, or may be set via an insulating layer (D).

As the thermosetting resin for the thermosetting resin varnish, materials used for ordinary enamel wires can be used. Examples thereof include polyamideimide (PAI), polyimide (PI), polyesterimide, polyetherimide, polyimide-hydantoin-modified polyester, polyamide, formal, polyurethane, a thermosetting polyester (PEst), Class H polyester (HPE), polyvinylformal, an epoxy resin, and polyhydantoin.

Polyimide-series resins such as a polyimide (PI), a polyamideimide (PAI), a polyesterimide, a polyetherimide, and a polyimidehydantoin-modified polyester are preferable, since they are excellent in heat resistance. An ultraviolet curable resin and the like may be used.

Further, regarding these thermosetting resins, only one kind thereof may be used alone, or more than one kind thereof may be used by mixture. Further, in a case of a laminated enamel-baked layer composed of multi-layered thermosetting resin layers (A), thermosetting resins which are different from each other in each layer may be used, or thermosetting resins whose mixing ratios are different from each other in each layer may be used.

In the present invention, as a thermosetting resin, a thermosetting resin selected from the group consisting of a polyimide (PI), a polyamideimide (PAI), a thermosetting polyester (PEst), a and an Class H polyester (HPE) is preferable, a polyimide (PI) or a polyamideimide (PAI) is more preferable, a polyimide (PI) is particularly preferable.

Here, the Class H polyester (HPE) means an aromatic polyester resin modified by adding thereto a phenol resin or the like and the heat resistant grade thereof is Class H. Examples of commercially available Class H polyesters (HPE) include ISONEL200 (trade name, manufactured by Schenectady International Inc.).

The polyimide (PI) is not particularly limited, but any of polyimide resins such as a whole aromatic polyimide and a thermosetting aromatic polyimide may be used. For example, use may be made of a commercially available product (for example, trade name, U IMIDE, manufactured by Unitika Ltd.; trade name, U-VARNISH, manufactured by Ube Industries, Ltd.; and trade name, #3000, manufactured by Du Pont-Toray Co., Ltd.), or use may be made of polyimides obtained by a usual method in which an aromatic tetracarboxylic dianhydride and aromatic diamines are reacted in a polar solvent to obtain a polyamide acid solution, and then the obtained polyamide acid solution is subjected to imidization by a thermal treatment at the time of baking in formation of the coating.

Regarding the polyamideimide (PAI), use may be made of a commercially available product (for example, trade name, HI406, manufactured by Hitachi Chemical Co., Ltd.), or use may be made of polyamideimides obtained by a usual method, for example, a method in which a tricarboxylic anhydride and diisocyanates are directly reacted in a polar solvent, or a method in which diamines are reacted with a tricarboxylic anhydride in a polar solvent to previously introduce an imide bond to the reaction product, and then the reaction product is subjected to amidation using diisocyanates.

Note that the polyamideimide (PAI) has the properties of a lower thermal conductivity and a higher dielectric breakdown voltage than other resins, and also has bake hardenability.

In order to prevent adhesion between the conductor and the enamel-baked layer from being extremely lowered in a case where the number of passages through a baking furnace is reduced, the thickness of the enamel-baked layer is 60 μm or less, and preferably 50 μm or less. Further, in order to prevent deterioration of voltage resistance or heat resistance, which are properties required for the enameled wires as insulated wires, it is preferable that the enamel-baked layer has a certain thickness. The lower limit of the thickness of the enamel-baked layer is not particularly limited, as long as it is a thickness where no pinholes are formed. The thickness of the enamel-baked layer is preferably 3 μm or more, more preferably 6 μm or more. Note that the thickness described here means a thickness of the layer without a convex portion, and it may be an average thickness.

The enamel-baked layer is may be a single layer or a multiple layers.

In the present invention, an enamel-baked layer of a thermosetting resin layer (A) is provided with a thick portion on the thermosetting resin layer (A) having the above-described thickness, so that the thermosetting resin layer (A) has a convex portion whose thickness becomes a maximum in a cross-sectional shape.

Regarding a cross-sectional shape of the enamel-baked layer of the thermosetting resin layer (A), a conventional enamel-baked layer is composed of two pairs of two sides facing each other, as shown in FIG. 6. In the present invention, at least four convex portions are set on any of the four sides. This increases a surface area of the interface (a length of the interface in a cross-sectional shape) at which the enamel-baked layer is in contact with a layer located at the upper layer thereof, particularly an extrusion-coated resin layer or an interlayer such as an adhesion layer. Further, by the presence of a maximum convex portion, resistance to shear deformation due to a force applied from a lateral side of the insulated wire is increased, so that occurrence of a film delamination becomes less at the interface which is shared with two layers. As a result, this enables to prevent occurrence of a film delamination of the extrusion-coated resin layer of the thermoplastic resin layer (B) from the conductor.

In the present invention, in order to effectively develop such an action, the film thickness of the convex portion and the location of at least four convex portions on the surface of the sides are specified.

(Shape and Film Thickness of Convex Portion)

In the present invention, in one side having the convex portion, provided that a minimum film thickness that is a film thickness of the flat portion in the state of having no convex portion is designated as "a" μm, and a maximum film thickness of the convex portion, or in a case of having more than one convex portion, an average of a maximum film thicknesses of the convex portions is designated as "b" μm, the a/b ratio is 0.60 or more and 0.90 or less. Accordingly, in a case where the multiple sides have convex portion, the value of a/b is 0.60 or more and 0.90 or less in each of the sides.

Further, in a case where one side has multiple convex portions, the value of a/b is preferably 0.60 or more and 0.90 or less in each of the sides.

Here, the minimum film thickness is a film thickness in a state without a convex portion as mentioned above, and is a film thickness of the portion in which no convex portion has been formed on the same side.

Note that in the present invention, the maximum convex portion (convex portion having a maximum value) is not only limited to a convex portion having such a shape that a film thickness shows an inflection point at both sides of the convex portion, but also, for example, in a case where a convex portion is set on an edge portion of the side, includes a convex portion whose film thickness does not show any inflection point in the edge direction or the short side direction (thickness direction) of the side on which a convex portion has been formed. Further, regarding a convex portion in the present invention, the convex portion and the edge portion of each side, or the convex portion and the flat portion smoothly connect with each other and therefore the convex portion does not protrude in a rectangular shape from a flat portion, so that a stress does not concentrate on the interface between the convex portion and the edge portion of each side, or on the interface between the convex portion and the flat portion. Here, in a case of each having one convex portion in the vicinity of each of both edge portions of the side, regarding a connection of the convex portion and the edge portion of the side, the convex portion may be connected with the edge portion of the side via a flat portion, or may be directly connected with the edge portion of the side. If the convex portion and the edge portion of the side, or the convex portion and the flat portion are smoothly connected with each other, a resin for coating an upper layer also circles around sufficiently to the underside.

The value of a/b is preferably 0.65 or more and 0.85 or less, and more preferably 0.70 or more and 0.80 or less.

If the a/b ratio falls below 0.60, a difference of the film thickness within the enamel-baked layer becomes larger. In the baking, such large difference causes unevenness of the baking between a portion of a minimum film thickness and a portion having a thicker film thickness of the convex portion. As a result, a residual solvent is partially apt to be accumulated, and the residual solvent causes foam formation which results in poor appearance. In particular, in a maximum portion of the convex portion whose film thickness is maximized, the baking becomes incomplete. Consequently, the residual solvent increases, so that it allows for easy foam formation.

If the a/b ratio exceeds 0.90, a sufficient dimension of adhesion cannot be obtained between an enamel-baked layer and an extrusion-coated resin layer, which results in decrease in a targeted workability. The value of a/b is desirably set at 0.80 or less.

On the other hand, the minimum film thickness a is preferably 3 μm or more and 60 μm or less, more preferably 6 μm or more and 50 μm or less, furthermore preferably 10 μm or more and 50 μm or less, particularly preferably 20 μm or more and 50 μm or less.

Further, the maximum film thickness of the convex portion b or the average of the maximum film thicknesses of the convex portion is preferably 20 μm or more and 60 μm or less, more preferably 20 μm or more and 55 μm or less, furthermore preferably 25 μm or more and 55 μm or less.

Regarding a cross-sectional shape of the convex portion in the present invention, such a convex portion that the thickness thereof sequentially increases and after the maximum point, in reverse, the thickness sequentially decreases as shown in FIGS. 1 to 5, is preferred. So-called mountain-shaped convex portion is preferred. That is, such a convex portion that after a summit of the convex portion (such a summit of the maximum point that the thickness sequentially increases even if the thickness becomes flat at one time toward the maximum point, in other words, sequentially increases without decrease), the thickness sequentially decreases without increase, is preferred.

Note that the proportion of the bottom of the convex portion may be a whole extent of the side or a part thereof. However, to a level where at least a flat portion and a minimum film thickness can be observed, presence of the flat portion is preferred (Layout Method of Four Convex Portions on Sides)

In the present invention, the convex portions are set as described in the following (1) or (2).

1) At least one convex portion is set on each of four sides.

2) At least two convex portions are set on each of at least two sides facing each other.

Note that, in the description, the "side" means only a straight-line portion containing no edge portion having the above-described curvature radius r, so-called, a straight-line portion before setting a convex portion.

The layout method 1) is more preferable than the layout method 2).

In the case of the layout method of the above 2), for the two sides facing each other, on which convex portions are set, long sides are more preferable than short sides. Further, it is preferred to set the convex portions in accordance with the layout method of the above 2), and further to set a convex portion on either one of the remaining two sides, and in this case, it is more preferred to set a convex portion on each of the remaining two sides. Regarding the convex portion set on the remaining two sides in this case, it is more preferred to set two convex portions than one convex portion with respect to one side. In this case, it is still more preferred to set two convex portions on each of two sides. In this case, the a/b ratio in the side having a newly set convex portion is preferably 0.6 or more and 0.9 or less.

In the present invention, at least four convex portions are set. The number of the convex portion which is set on one side is preferably two, and accordingly it is most effective to set two convex portions on each of four sides, namely a total of eight convex portions. If too many convex portions are set on one side, the area of the individual convex portion becomes small, so that the obtained effect tends to decrease as compared with the effect in the case where the number of the convex portion which is set on one side is two.

In the present invention, the value of a/b of the two sides facing each other may be the same or different from one another. In this case, in the cross-sectional shape of the two sides facing each other, regarding a configuration of the convex portion, point symmetry or line symmetry with respect to the center point or the center line of the two sides facing each other is preferred. The height of the convex portion may be different from one another in each side, or in each convex portion. However, in the case where there are two convex portions in the same side, when in-use of the insulated wire is simulated, it is preferred that the height of each of the convex portions is the same.

Here, in the present invention, in the case where one side has one convex portion, it is preferred that the convex portion is located in the vicinity of the center of the side.

On the other hand, in the case where one side has at least two convex portions, it is preferred that one convex portion is each located in the vicinity of each of both edges thereof, or one convex portion is located in the vicinity of one edge and another convex portion is located in a range from a halfway point between the center and an edge thereof to the another edge which does not have a convex portion, or one convex portion is located in a range from a halfway point between the center and an edge thereof to the edge thereof and another convex portion is located in a range from another halfway point between the center and another edge thereof to the another edge.

In the case where one side has at least two convex portions, it is particularly preferred that one convex portion is each located in the vicinity of each of both edges thereof, or one convex portion is located in a leftward range from a halfway point between the center and an edge thereof to the edge thereof and another convex portion is located in a rightward range from another halfway point between the center and another edge thereof to the another edge.

Note that the term "in the vicinity of the center of the side" means a range of ±L/10 from the center of the side, provided that L represents a length of the side. In the present invention, it is most preferred to set a maximum point of the convex portion at a center point.

On the other hand, the term "in the vicinity of the edge of the side" means a range of ±L/10 from the edge of the side. In the present invention, it is preferred to set a maximum point of the convex portion in the vicinity of the edge of the side.

For forming a thick convex portion on an enamel-baked layer of the thermosetting resin layer (A), there are a method of forming a convex portion on the corner portion of the enamel-baked layer by decreasing a viscosity of a resin varnish for forming the layer to adjust a line velocity, thereby using a surface tension, and a method of controlling formation of a convex portion by the shape of a die. Of these methods, the method of using a decrease in viscosity enables a convex portion to be set on the edge portion, but it is difficult to set the convex portion on an arbitrary portion and further it is difficult to control a thickness of the convex portion. Therefore, it is preferred to control the location and the thickness of the convex portion by a die shape.

<Thermoplastic Resin Layer (B)>

In the present invention, as an extrusion-coated resin layer, at least one thermoplastic resin layer (B) composed of a thermoplastic resin is present in contact with the enamel-baked layer of the thermosetting resin layer (A), or via an interlayer such as an adhesion layer.

By setting the extrusion-coated resin layer, an insulated wire having a high partial discharge inception voltage can be obtained.

The advantage of the extrusion-coating method is that because this method does not need to pass an insulating layer into a baking furnace in the production process, the thickness of the insulating layer can be increased without causing a growth of the thickness of an oxide layer of the conductor.

As a resin used in the extrusion-coated resin layer, a thermoplastic resin is used. In particular, it is preferred to use a thermoplastic resin which is excellent in heat resistance.

Examples of such thermoplastic resin include polytetrafluoroethylene (PTFE), a tetrafluoroethylene-hexafluoropropylene copolymer (FEP), a tetrafluoroethylene-ethylene copolymer (ETFE), a tetrafluoroethylene-perfluoroalkylvinylether copolymer (PFE), a thermoplastic polyamide (PA), a thermoplastic polyester (PE), polyethylene terephthalate (PET), polybutylene terephthalate (PBT), a thermoplastic polyimide (TPI), polyphenylenesulfide (PPS), polyetheretherketone (PEEK), a modified polyetheretherketone (modified PEEK), and the like.

Among them, examples of commercially-available products of PEEK include KETASPIRE KT-820 (trade name, manufactured by Solvay Specialty Polymers LLC), and PEEK450G (trade name, manufactured by Victrex Japan Co., Ltd.). Examples of commercially-available products of the modified PEEK include AVASPIRE AV-650 (trade name, manufactured by Solvay Specialty Polymers LLC), and AV-651 (trade name, manufactured by Solvay Specialty Polymers LLC). Examples of commercially-available products of TPI include AURUM PL450C (trade name, manufactured by Mitsui Chemicals, Inc.). Examples of commercially-available products of PPS include FORTRON 0220A9 (trade name, manufactured by Polyplastics, Co., Ltd.), and PPS FZ-2100 (trade name, manufactured by DIC Corporation). Examples of commercially-available products of the thermoplastic PA include Nyron 6, 6 FDK-1 (trade name, manufactured by Unitika Ltd.), Nyron, 4, 6 F-5000 (trade name, manufactured by Unitika Ltd.), Nyron 6, T ARLEN AE-420 (trade name, manufactured by Mitsui Chemicals, Inc.), Nyron 9, T GENESTA N 1006D (trade name, manufactured by Kuraray Co., Ltd.), and the like.

Further, examples of the modified PEEK include PEEK-based PPS, PES, PPSU or PEI polymer alloys, for example, trade name: AVASPIRE AV-621, AV-630, AV-651, AV-722, AV-848, and the like, manufactured by Solvay Specialty Polymers LLC.

Among the thermoplastic resin, modified PEEK, PEEK, PPS, and TPI are preferable.

Among them, considering both lowering of partial discharge inception voltage and resistance to solvents as a resin used in the extrusion-coated resin layer, it is more preferred to use a crystalline resin.

In particular, in the present invention, because resistance to damage of the film at the time of coil-work is required, it is preferred to use a modified PEEK, PEEK, or PPS, each of which is crystalline and in particular, has a high elastic modulus.

Note that regarding use of a thermoplastic resin, only one kind thereof may be used alone, or more than one kind thereof may be used in mixture. Further, in a case of a laminated extrusion-coated resin layer composed of multi-layer thermoplastic resin layers (B), a thermoplastic resin which is different from each other in each layer may be used, or a mixing ratio of thermoplastic resins which is different from each other in each layer may be used.

In the case where more than one kind of thermoplastic resin are used in mixture, for example, both resins can be used by subjecting them to polymer alloy thereby making a compatible type uniform mixture, or can be used by forming a non-compatible blend into a compatible state with a compatibilizing agent.

The thickness of the extrusion-coated resin layer means a thickness under the condition of the enamel-baked layer without a convex portion, and specifically a thickness of a flat portion where the enamel-baked layer has no convex portion. The thickness of the extrusion-coated resin layer in this sense is not particularly limited, but is preferably from 30 to 300 μm. If the thickness of the extrusion-coated resin layer is too small, an insulation property decreases and partial discharge characteristics tend to be deteriorated whereby a requirement for a coil cannot be satisfied. If the thickness of the extrusion-coated resin layer is too large, the stiffness of the insulated wire becomes too high. As a result, a bending work becomes difficult and also an increase in cost is caused.

In the present invention, the thickness of the extrusion-coated resin layer is more preferably 50 to 250 μm, furthermore preferably 60 to 200 μm.

Further, in the present invention, with respect to a cross-sectional shape of the laminated resin-coated layer, it is particularly preferred that the outer surface of the thermoplastic resin layer (B) is composed of two pairs of two sides facing each other, and in each side, a total thickness of the laminated resin-coated layer up to a conductor is the same in any portion of said side.

That is, as shown in FIGS. 1 to 5, it is preferred that the outer surface in the cross-sectional shape of the thermoplastic resin layer (B) becomes similar to the shape of the conductor. By forming it into such a shape, a strain due to a force applied from a lateral side is suppressed, so that the insulated wire can be maintained under the condition of high strength.

The thermoplastic resin layer (B) having such cross-sectional shape can be formed by subjecting a resin to extrusion coating by means of an extruder using a die so that an external shape of the cross-section of the extrusion-coated resin layer becomes similar to the shape of a conductor.

In the present invention, various additives such as a crystallization nucleating agent, a crystallization accelerator, a cell nucleating agent, an oxidation inhibitor, an antistatic agent, an anti-ultraviolet agent, a light stabilizer, a fluorescent brightening agent, a pigment, a dye, a compatibilizing agent, a lubricating agent, a reinforcing agent, a flame retardant, a crosslinking agent, a crosslinking aid, a plasticizer, a thickening agent, a thinning agent, and an elastomer may be incorporated into the material for obtaining an extrusion-coated resin layer, to the extent that the characteristics are not affected. Furthermore, a layer formed from a resin containing these additives may be laminated on the resulting insulated wire, or the insulated wire may be coated with a coating material containing these additives.

<Non-Crystalline Resin Layer (C)>

In the present invention, an insulating layer is also preferably provided as an interlayer between a thermosetting resin layer (A) and a thermoplastic resin layer (B).

The foregoing interlayer is preferably an adhesion layer which increases an adhesive property between the thermosetting resin layer (A) and the thermoplastic resin layer (B) in which different resins in their properties are used.

Regarding the adhesion layer, a non-crystalline resin layer (C) composed of a non-crystalline resin is preferred.

Note that the term "crystalline" in the present invention means a characteristic which is able to have a regularly arranged crystalline organization in at least one part of the polymer chain under a favorite environment for crystallization. The term "non-crystalline" means to maintain an amorphous state which has almost no crystalline structure and also means such a characteristic that a polymer chain becomes a random state at curing.

Examples of the non-crystalline resin used in the present invention include polysulfone (PSU), polyethersulfone (PES), polyetherimide (PEI), polyphenylsulfone (PPSU), and polyphenyleneether (PPE). It is preferred to use a non-crystalline resin selected from these resins, for the adhesion layer which increases an adhesive property. In the present invention, polyethersulfone (PES), polyetherimide (PEI), polyphenylsulfone (PPSU), and polyphenyleneether (PPE) are more preferred. By this resin, workability is further improved, which operates in favor of suppressing occurrence of delamination of an extrusion-coated resin layer of a thermoplastic layer (B) from a conductor, and also enhancing an action of the convex portion which an enamel-baking layer has thereon.

Regarding the PSU, UDEL PSU (trade name, manufactured by Solvay Advanced Polymers, LLC) and the like may be used.

Regarding the PES, SUMIKA EXCEL 4800G (trade name, manufactured by Sumitomo Chemical Co., Ltd.), PES (trade name, manufactured by Mitsui Chemicals, Inc.), ULTRAZONE E (trade name, manufactured by BASF Japan Ltd.), RADEL A (trade name, manufactured by Solvay Advanced Polymers, LLC) and the like may be used.

Regarding the PEI, ULTEM 1010 (trade name, manufactured by Saudi Basic Industries Corporation) and the like may be used.

Regarding the PPSU, RADEL R5800 (trade name, manufactured by Solvay Advanced Polymers, LLC) and the like may be used.

Regarding the PPE, XYRON (trade name, manufactured by Asahi Kasei Chemicals Corporation), IUPIACE (trade name, manufactured by Mitsubishi Engineering-Plastics Corporation) and the like may be used.

The thickness of the non-crystalline resin layer (C) is preferably 0.5 to 20 μm, more preferably 2 to 15 μm, furthermore preferably 3 to 12 μm, particularly preferably 3 to 10 μm.

Note that regarding the thickness of the non-crystalline resin layer (C), including a convex shape and a flat portion of the enamel-baked layer, a uniform thickness thereof is preferred. If the non-crystalline resin layer (C) is thinner than the enamel-baked layer, such uniform thickness can be easily formed.

The non-crystalline resin layer (C) can be formed by solving a non-crystalline resin in an organic solvent such as N-methyl-2-pyrrolidone (NMP) to prepare a resin varnish, and then coating the resin varnish on an enamel-baked layer using a die similar to the shape of a conductor, and then baking the coated resin varnish.

Regarding the organic solvent for the resin varnish, organic solvents exemplified above with respect to the resin varnish for enamel-baked layer are preferred.

Further, specific baking conditions depend on a shape or the like of the furnace to be used, but the conditions described above with respect to the foregoing enamel-baked layer are preferred.

<Insulating Layer (D)>

In the present invention, an insulating layer (D) other than the above non-crystalline resin layer (C) may be set between a conductor and an enamel-baked layer of a thermosetting resin layer (A).

Regarding the insulating layer (D), any resin may be used, as long as the resin neither causes a poor appearance nor considerably lowers adhesion between the conductor and the insulating layer (D), and also between the insulating layer (D) and the thermosetting resin layer (A).

It is preferred to set an enamel-baked layer of the thermosetting resin layer (A) on the conductor without the insulating layer (D), and also to set a thermoplastic resin layer (B) or a non-crystalline resin layer (C) on the outside thereof.

<<Method of Producing an Insulated Wire>>

The method of producing the insulated wire of the present invention is as explained in individual layers.

Hereinafter, an example of the method of producing the insulated wire of the present invention is described in detail.

That is, a varnish-made resin on the outer periphery of the enamel-baked layer is baked to form the adhesive layer. And then, a thermoplastic resin for forming the extrusion-coated resin layer, the thermoplastic resin preferably becoming a molten state at a higher temperature than a glass transition temperature of the resin that is used for the adhesive layer when the extrusion-coated resin layer is formed, is extruded onto the adhesive layer thereby to contact with the adhesive layer, and the extrusion-coated resin is heat-sealed to the enamel-baked layer via the adhesive layer thereby to form the extrusion-coated resin layer.

Here, in the present invention, the adhesive layer is not coated by extruding, but provided by coating a varnish-made resin (resin varnish).

<<Method of Producing a Film Delamination-Resistant Insulated Wire>>

The method of producing a film delamination-resistant insulated wire of the present invention allows the insulated wire to be prevented from occurrence of delamination of the extrusion-coated resin layer of the thermoplastic resin layer (B) from a conductor of the insulated wire.

That is, in the method of manufacturing a film delamination-resistant insulated wire, the insulated wire is composed of a laminated resin-coated insulated wire having a thermosetting resin layer (A) directly or via an insulating layer (D) on a conductor having a rectangular cross-section, and having at least a thermoplastic resin layer (B) on the outer periphery of the thermosetting resin layer (A), in which in the cross-sectional shape of the laminated resin-coated layer, the thermosetting resin layer (A) includes two pairs of two sides facing each other, and has at least four convex portions each of which has a film thickness in maximum, and the method includes:

forming said at least four convex portions by at least one convex portion on each of the four sides, or by at least two convex portions on each of the at least two sides facing each other; and in the each side having the convex portion, provided that a minimum film thickness is designated as "a" μm, and an average of a maximum film thickness of the convex portion is designated as "b" μm, each forming said convex portion to satisfy the a/b ratio of 0.60 or more and 0.90 or less, thereby preventing an occurrence of delamination of the thermoplastic resin layer (B) from the conductor of the insulated wire.

The insulated wire of the present invention and the method of producing the same are described above.

Prevention of the film delamination is due to the presence of the above at least four convex portions, as mentioned above.

The insulated wire of the present invention has the above-described features and therefore it is applicable to a field which requires resistance to voltage and heat resistance, such as various kinds of electric equipment (may be also called electronic equipment). For example, the insulated wire of the present invention is used for a motor, a transformer and the like, which can compose high-performance electric equipment by being processed into a coil. In particular, the insulated wire is preferably used as a winding for a driving motor of HV (Hybrid Vehicles) and EV (Electric Vehicles). As just described, the present invention can provide electric equipment, particularly a driving motor of HV and EV, equipped with a coil obtained from the insulated wire. Meanwhile, in the case where the insulated wire of the present invention is used for a motor coil, it is also called an insulated wire for the motor coil.

EXAMPLES

The present invention will be described in more detail based on examples given below, but the invention is not meant to be limited by these.

Example 1

As the conductor, a cross-section rectangular (long side 3.2 mm×short side 2.4 mm, curvature radius of chamfered edge at four corners r=0.3 mm) conductor (copper having an oxygen content of 15 ppm) was used.

In formation of the thermosetting resin layer (A) [enamel-baked layer], using a die having a shape similar to the shape of the thermosetting layer (A) to be formed on the conductor, a polyimide resin (PI) varnish (trade name, U-IMIDE, manufactured by Unitika Ltd.) was coated on the conductor, and then the coated conductor was passed through a 8 m-long baking furnace set to 450° C. at a speed requiring 15 seconds for the baking time, and then this step was repeated several times to form the thermosetting resin layer (A), thereby obtaining an enamel wire.

Figure 1:
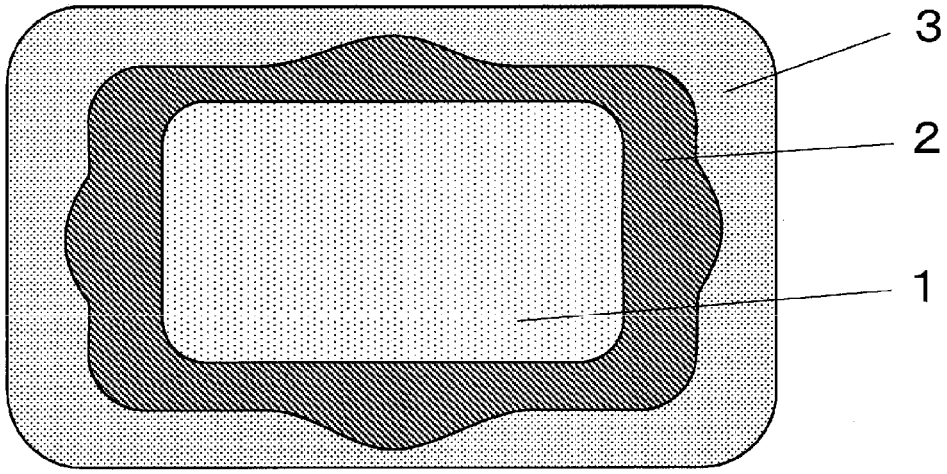
FIG. 1 is a schematic cross-sectional view of a laminated resin-coated insulated wire of the present invention having an enamel-baked layer on a rectangular conductor, in which one thick convex portion is set in the center of each side of four sides of the enamel-baked layer.

The formed thermosetting resin layer (A) had one maximum convex portion at the center of the side in each of four sides, as shown in FIG. 1. In each side, the maximum film thickness of the maximum convex portion was 50 μm, and the minimum film thickness was 35 μm, and in each side, the ratio of the minimum film thickness to the maximum film thickness of the maximum convex portion was 0.70.

The obtained enamel wire was used as a core wire. An extrusion-coated resin layer was formed as described below using a screw of the extruder specified by 30 mm full flight, L/D=20, and compression ratio 3.

As the thermoplastic resin, a polyetherether ketone (PEEK) (trade name, KETASPIRE KT-820, manufactured by Solvay Specialty Polymers, LLC, relative permittivity: 3.1) was used. The PEEK was extrusion-coated using an extrusion die in such a manner that the outer shape of the cross-section of the extrusion-coated resin layer becomes a shape similar to the shape of the conductor. As a result, a thermoplastic resin layer (B) [extrusion-coated resin layer] having a 150 μm-thick flat portion without a convex portion was formed on the outside of the thermosetting resin layer (A), thereby obtaining an insulated wire composed of a PEEK extrusion-coated enamel wire.

Example 2

A thermosetting resin layer (A) having the shape shown in FIG. 1 was formed to obtain an enamel wire in the same manner as Example 1, except that the resin varnish of the thermosetting resin layer (A) in Example 1 was replaced with Class H polyester resin (HPE) varnish (trade name, ISONEL200, manufactured by US Schenectady International Incorporated).

The formed thermosetting resin layer (A) had one maximum convex portion at the center of the side in each of four sides, as shown in FIG. 1. In each side, the maximum film thickness of the maximum convex portion was 42 μm, and the minimum film thickness was 35 μm, and in each side, the ratio of the minimum film thickness to the maximum film thickness of the maximum convex portion was about 0.83.

Note that this ratio was rounded off to two decimal places and was shown in Table 1. Hereinafter, in an indivisible case, the ratio was also shown in Table 1 in the same manner as mentioned above.

The obtained enamel wire was used as a core wire. A thermoplastic resin layer (B) as shown in FIG. 1 was formed on the outside of the thermosetting resin layer (A) so that the thermosetting resin layer (B) had a thickness of 100 μm of a flat portion having no convex portion in the same manner as Example 1, except that the thermoplastic resin in Example 1 was replaced with a polyphenylenesulfide resin (PPS) (trade name, FZ-2100, manufactured by DIC Corporation, relative permittivity: 3.4). Thus, an insulated wire composed of a PPS extrusion-coated enamel wire was obtained.

Example 3

A thermosetting resin layer (A) having the shape shown in FIG. 5 was formed to obtain an enamel wire in the same manner as Example 1, except that the resin varnish of the thermosetting resin layer (A) in Example 1 was replaced with a polyamideimide resin (PAI) varnish (trade name, HI406, manufactured by Hitachi Chemical Co., Ltd.).

The formed thermosetting resin layer (A) had two convex portions in the vicinity of each of both edges of the side in each of four sides, as shown in FIG. 5. In each side, an average of a maximum film thickness of two convex portions was 42 μm, and a minimum film thickness was 30 μm, and in each side, the ratio of a minimum film thickness to an average of a maximum film thickness of the convex portion was about 0.71.

Next, a resin varnish in which a polyetherimide resin (PEI) (manufactured by SABIC Innovative Plastics, Trade name: ULTEM 1010) had been dissolved in N-methyl-2-pyrrolidone (NMP) so as to be a 20-mass % solution was coated on the foregoing enameled wire, by using a die with a shape similar to the shape of the conductor, and then passing it through an 8 m-long baking furnace set to 450° C., at a speed so that the baking time period would be 15 seconds to form a non-crystalline resin layer (C) [adhesion layer] having a thickness of 6 μm, an enamel wire with an adhesive layer was obtained.

Note that a non-crystalline resin layer (C) [adhesion layer] is omitted in FIG. 5, but the non-crystalline resin layer (C) [adhesion layer] having a uniform thickness is present on the thermosetting resin layer (A).

The obtained enamel wire with an adhesion layer was used as a core wire. As the thermoplastic resin, the same PEEK as Example 1 was used. The thermosetting resin layer (A) was formed on the outside of the non-crystalline resin layer (C) [adhesion layer] so that the thermoplastic resin layer (B) as shown in FIG. 5 had a thickness of 70 μm of a flat portion having no convex portion in the same manner as Example 1. Thus, an insulated wire composed of a PEEK extrusion-coated enamel wire was obtained.

Examples 4 and 5

A thermosetting resin layer (A) having the shape shown in FIG. 5 and the thickness shown in the following Table 1 was formed to obtain an enamel wire in the same manner as Example 3, except that the resin varnish for the thermosetting resin layer (A) used in Example 3 was change to the same PI as Example 1.

Next, by solving the resin for the non-crystalline resin layer (C) [adhesion layer] shown in the following Table 1 in N-methyl-2-pyrrolidone (NMP), the non-crystalline resin layer (C) having the thickness shown in the following Table 1 was formed in the same manner as Example 3, thereby obtaining an enamel wire with an adhesion layer.

By using the obtained enamel wire with an adhesion layer as a core and also using the resin shown in the following Table 1 for the thermoplastic resin, a thermoplastic resin layer (B) having the thickness shown in the following Table 1 was formed on the outside of the non-crystalline resin layer (C) [adhesion layer] in the same manner as Example 3, thereby obtaining an insulated wire.

Here, regarding the resin of the non-crystalline resin layer (C), use was made of a polyphenylsulfone resin (PPSU) (trade name, RADEL R5800, manufactured by Solvay Specialty Polymers, LLC, glass transition temperature: 220° C.) in Example 4 and a polyethersulfone resin (PES) (trade name, SUMIKAEXEL 4800G, manufactured by Sumitomo Chemical Co., Ltd.). Regarding the resin for the thermoplastic resin layer (B), use was made of a thermoplastic polyimide (TPI) (trade name, AURUM PL450C, manufactured by Mitsi Chemicals, Inc.) in Example 4 and a modified polyetheretherketone resin (modified PEEK) (trade name, AVASPIRE AV-650, manufactured by Solvay Specialty Polymers, LLC, relative permittivity: 3.1) in Example 5.

Example 6

A thermosetting resin layer (A) having the shape shown in FIG. 1 and the thickness shown in the following Table 1 was formed using the same PI as Example 1 as the resin varnish for the thermosetting resin layer (A) in the same manner as Example 1, thereby obtaining an enamel wire.

The obtained enamel wire was used as a core wire. A thermoplastic resin layer (B) having the thickness shown in the following Table 1 was formed on the outside of the thermosetting resin layer (A) in the same manner as Example 1, except that the thermoplastic resin in Example 1 was replaced with a polyethyleneterephthalate (PET) (trade name, TR8550, manufactured by Teijin Limited, glass transition temperature: 70° C.). Thus, an insulated wire composed of a PET extrusion-coated enamel wire was obtained.

Examples 7 to 10

A thermosetting resin layer (A) having the shape of the coated resin layer shown in the following Table 1 and the thickness shown in the following Table 1 was formed to obtain an enamel wire in the same manner as Example 3, except that the resin varnish for the thermosetting resin layer (A) in Example 3 was replaced with a resin varnish shown in the following Table 1.

Next, using the same PEI as Example 3, a non-crystalline resin layer (C) having the thickness shown in the following Table 1 was formed in the same manner as Example 3, thereby obtaining an enamel wire with an adhesion layer.

By using the obtained enamel wire with the adhesion layer as a core and also using the same PEEK as Example 3 for the thermoplastic resin, a thermoplastic resin layer (B) having the thickness shown in the following Table 1 was formed on the outside of the non-crystalline resin layer (C) [adhesion layer] in the same manner as Example 3, thereby obtaining an enamel wire.

Here, regarding the resin for the thermosetting resin layer (A), the same PI as Example 1 was used in Examples 7, 8, and 10, and the same PAI as Example 3 was used in Example 9.

Examples 11 to 16

Insulated wires of Examples 11, 13 and 15 having the compositions shown in the following Table 2 were prepared in the same manner as Examples 1 and 8, and Insulated wires of Examples 12, 14 and 16 having the compositions shown in the following Table 2 in the same manner as Examples 3 and 9.

Here, in Examples 15 and 16, as shown in the following Table 2, the thickness or the average thickness of the convex portions provided on two long sides was changed so as to be different from one another in each side. Further, the thickness or the average thickness of the convex portions provided on two short sides was also changed so as to be different from one another in each side.

Here, regarding the resin for the thermosetting resin layer (A), the same PI as Example 1 was used in Examples 11, 13 to 15, and the same PAI as Example 3 was used in Examples 12 and 16. Regarding the resin for the non-crystalline resin layer (C), the same PEI as Example 3 was used in Examples 12 and 16. The same PES as Example 5 was used in Examples 14. Further, regarding the resin for the thermoplastic resin layer (B), the same PEEK as Example 1 was used in Examples 11 to 13, 15 and 16, and the same modified PEEK as Example 5 was used in Examples 14.

Comparative Examples 1 to 6

According to Example 1 in Comparative Example 1 and according to Example 3 in Comparative Examples 2 to 6, the insulated wires each having the constitution shown in the following Table 3 were prepared.

Here, regarding the resin for the thermosetting resin layer (A), the same PAI as Example 3 was used in Comparative Examples 1 and 3, and the same PI as Example 1 was used in Comparative Examples 2, and 4 to 6. Regarding the resin for the non-crystalline resin layer (C), the same PES as Example 5 was used in Comparative Example 2, and the same PEI as Example 3 was used in Comparative Examples 3 to 6. Further, regarding the resin for the thermoplastic resin layer (B), the same TPI as Example 4 was used in Comparative Example 1, and the same PPS as Example 2 was used in Comparative Example 2, and the same PEEK as Example 1 was used in Comparative Examples 3 to 6.

The following evaluations of each of the insulated wires prepared above were conducted.

[Workability Evaluation (Adhesion Property of Film)]

A twist test was carried out to evaluate workability, especially an adhesion property of the film when a shear stress was applied between the layers of the insulated wire. With reference to "Delamination Test" prescribed in Section 5.4 of JIS-C3216-3, the number of twist until the thermoplastic resin layer (B) [extrusion-coated resin layer] was delaminated from the thermosetting resin layer (A) [enamel-baked layer] was measured and an average value of five tests was computed. Hereinafter, details of the test will be described.

At first, each insulated wire was cut into 50 cm-length pieces, and the thermoplastic resin layer (B) [extrusion-coated resin layer] of 1 cm from each end thereof was delaminated in four directions, and in the case of having a non-crystalline resin layer (C) [adhesion layer], this layer was also delaminated in four directions at the same time, thereby making the thermoplastic resin layer (B) [extrusion-coated resin layer] exposed. Next, one end of the insulated wire was fixed in this state, and the other end was twisted by a given load (load amount: 100 N) in one direction, and the number of twist until film delamination of the thermoplastic resin layer (B) [extrusion-coated resin layer] was observed, was measured. If the number of twist was 10 or more, the workability was judged as being acceptable and was ranked on a scale of "C" to "A". In this regard, the rank "C" indicates that the number of twist was 10 or more and less than 20. The rank "B" indicates that the number of twist was 20 or more and less than 30.

The rank "A" indicates that the number of twist was 30 or more. If the number of twist was less than 10, the workability was judged as being unacceptable and was ranked on a scale of "D".

[Appearance Evaluation]

Each insulated wire was cut into 10 cm-length pieces, and the thermoplastic resin layer (B) [extrusion-coated resin layer] directly after the cutting was delaminated from the insulated wire and a surface of the thermoplastic resin layer (B) and a surface of the bare thermosetting resin layer (A) [enamel-baked layer] were observed by a microscope (magnification: 50 times). The insulated wire having the thermoplastic resin layer (B) [extrusion-coated resin layer] and the thermosetting resin layer (A) [enamel-baked layer] each of which neither causes foam formation nor has a deficit was judged as being acceptable and was ranked on a scale of "A". Further, the insulated wire having the thermoplastic resin layer (B) [extrusion-coated resin layer] and the thermosetting resin layer (A) [enamel-baked layer], in any one of which both foam formation and a deficit were observed was judged as being unacceptable and was ranked on a scale of "C".

The obtained results are shown together in Tables 1 to 3.

Note that regarding the thicknesses of a minimum film thickness and an average of maximum film thicknesses of the convex portion of the thermosetting resin layer (A) as well as the thicknesses of the thermoplastic resin layer (B) and the thicknesses of the non-crystalline resin layer (C) shown in Tables 1 to 3, the unit thereof is μm.

TABLE 1

Figure 2:
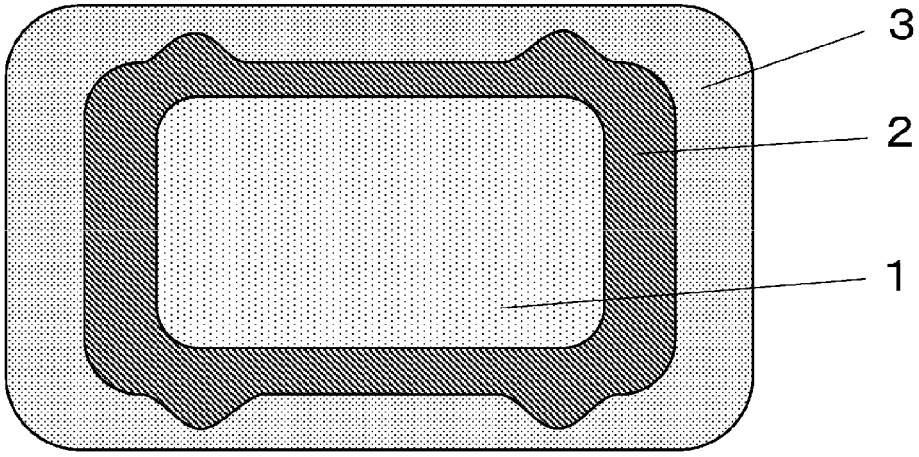
FIG. 2 is a schematic cross-sectional view of a laminated resin-coated insulated wire of the present invention having an enamel-baked layer on a rectangular conductor, in which thick convex portions are set in the vicinity of each of both edges of each of two long sides facing each other.
Figure 3:
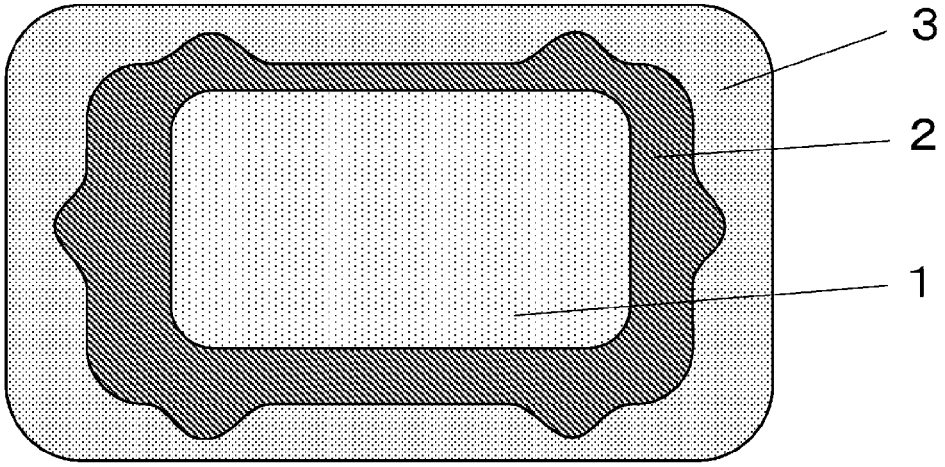
FIG. 3 is a schematic cross-sectional view of a laminated resin-coated insulated wire of the present invention having an enamel-baked layer on a rectangular conductor, in which thick convex portions are set in the vicinity of each of both edges of each of two long sides facing each other, and a thick convex portion is set in the center of each of two short sides facing each other.

| | | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|---|
| Thermosetting resin layer (A) [enamel-baked layer] | Kind of resin | PI | HPE | PAI | PI | PI | PI | PI | PI | PAI | PI |
| | Shape of coating resin layer | FIG. 1 One convex portion on each of four sides | FIG. 1 One convex portion on each of four sides | FIG. 5 Two convex portions on each of four sides | FIG. 5 Two convex portions on each of four sides | FIG. 5 Two convex portions on each of four sides | FIG. 1 One convex portion on each of four sides | FIG. 5 Two convex portions on each of four sides | FIG. 3 Two convex portions on each of long sides facing each other/ One convex portion on each of short sides | FIG. 4 Two convex portions on each of short sides facing each other/ One convex portion on each of long sides | FIG. 2 Two convex portions on both edges of each of long sides facing each other |
| | Minimum film thickness | 35 | 35 | 30 | 25 | 45 | 40 | 38 | 38 | 38 | 38 |
| | Average of maximum film thicknesses of convex portion | 50 | 42 | 42 | 42 | 52 | 50 | 51 | 51 | 51 | 51 |
| | Minimum film thickness/Average of maximum film thicknesses of convex portion | 0.70 | 0.83 | 0.71 | 0.60 | 0.87 | 0.8 | 0.75 | 0.75 | 0.75 | 0.75 |
| Non-crystalline resin layer (C) [adhesion layer] | Kind of resin | — | — | PEI | PPSU | PES | — | PEI | PEI | PEI | PEI |
| | Thickness | — | — | 6 | 5 | 5 | — | 6 | 6 | 6 | 6 |
| Thermoplastic resin layer (B) [extrusion-coated resin layer] | Kind of resin | PEEK | PPS | PEEK | TPI | Modified PEEK | PET | PEEK | PEEK | PEEK | PEEK |
| | Thickness | 150 | 100 | 70 | 80 | 200 | 150 | 60 | 70 | 70 | 70 |
| Evaluation items of insulated wire | Workability | B | B | A | A | A | B | A | A | B | C |
| | Appearance | A | A | A | A | A | A | A | A | A | A |

"Ex." is an abbreviation of Example.

TABLE 2

| | | Ex. 11 | Ex. 12 | Ex. 13 | Ex. 14 | Ex. 15 | Ex. 16 |
|---|---|---|---|---|---|---|---|
| Thermosetting resin layer (A) [enamel-baked layer] | Kind of resin | PI | PAI | PI | PI | PI | PAI |
| | Shape of coating resin layer | FIG. 1 One convex portion on each of four sides | FIG. 5 Two convex portions on each of four sides | FIG. 3 Two convex portions on each of long sides facing each other/One convex portion on each of short sides | FIG. 4 Two convex portions on each of short sides facing each other/One convex portion on each of long sides | FIG. 1 One convex portion on each of four sides | FIG. 5 Two convex portions on each of four sides |

TABLE 2-continued

| | | Ex. 11 | | Ex. 12 | | Ex. 13 | | Ex. 14 | | Ex. 15 | | Ex. 16 | |
|---|---|---|---|---|---|---|---|---|---|---|---|---|---|
| | | Longer side | Shorter side | Longer side | Shorter side | Longer side | Shorter side | Longer side | Shorter side | Longer side | Shorter side | Longer side | Shorter side |
| | Minimum film thickness | 35 | 35 | 30 | 25 | 35 | 38 | 45 | 40 | 35, 35 | 35, 35 | 30, 30 | 25, 25 |
| | Average of maximum film thicknesses of convex portion | 50 | 42 | 42 | 42 | 51 | 51 | 52 | 50 | 45, 50 | 40, 42 | 38, 42 | 35, 40 |
| | Minimum film thickness/Average of maximum film thicknesses of convex portion | 0.70 | 0.83 | 0.71 | 0.60 | 0.69 | 0.75 | 0.87 | 0.80 | 0.78, 0.70 | 0.88, 0.83 | 0.79, 0.71 | 0.71, 0.63 |
| Non-crystalline resin layer (C) [adhesion layer] | Kind of resin | — | | PEI | | — | | PES | | — | | PEI | |
| | Thickness | — | | 6 | | — | | 5 | | — | | 6 | |
| Thermoplastic resin layer (B) [extrusion-coated resin layer] | Kind of resin | PEEK | | PEEK | | PEEK | | Modified PEEK | | PEEK | | PEEK | |
| | Thickness | 150 | 100 | 70 | 80 | 60 | 70 | 150 | 200 | 150 | 100 | 70 | 80 |
| Evaluation items of insulated wire | Workability | B | | A | | A | | A | | B | | A | |
| | Appearance | A | | A | | A | | A | | A | | A | |

"Ex." is an abbreviation of Example.

TABLE 3

Figure 7:
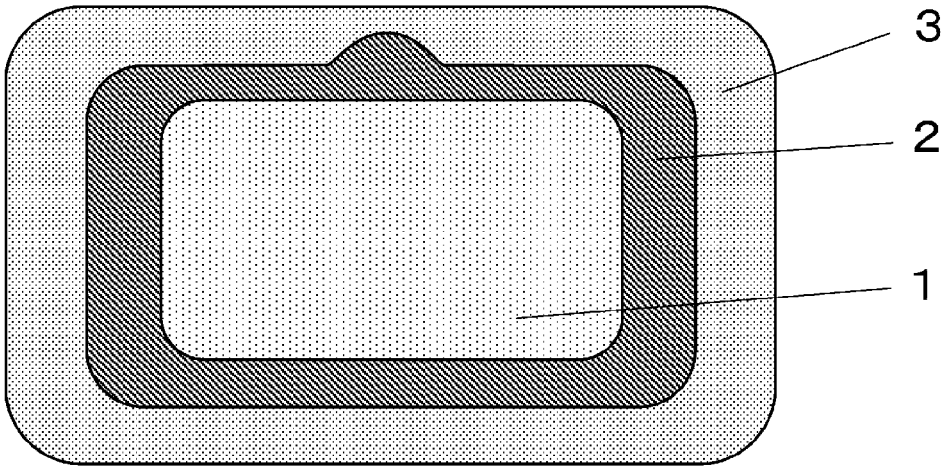
FIG. 7 is a schematic cross-sectional view of a laminated resin-coated insulated wire of the present invention having an enamel-baked layer on a rectangular conductor, in which a thick convex portion is set in one long side.
Figure 8:
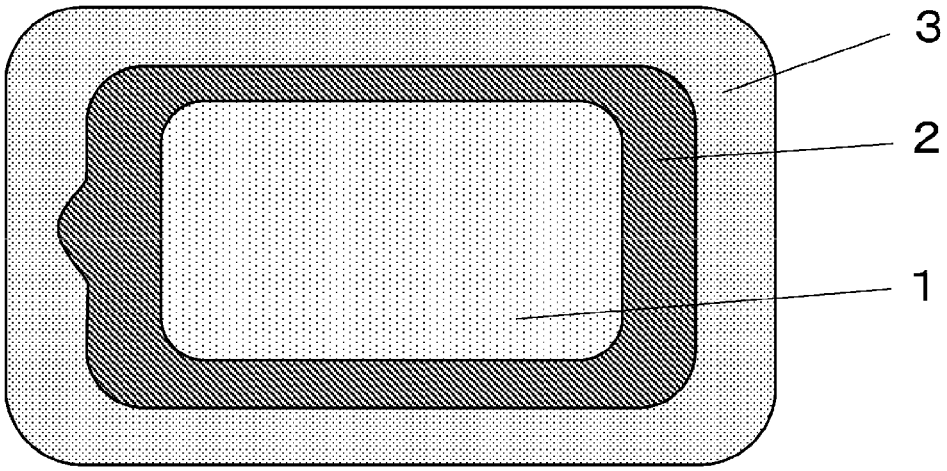
FIG. 8 is a schematic cross-sectional view of a laminated resin-coated insulated wire of the present invention having an enamel-baked layer on a rectangular conductor, in which a thick convex portion is set in one short side.
Figure 9:
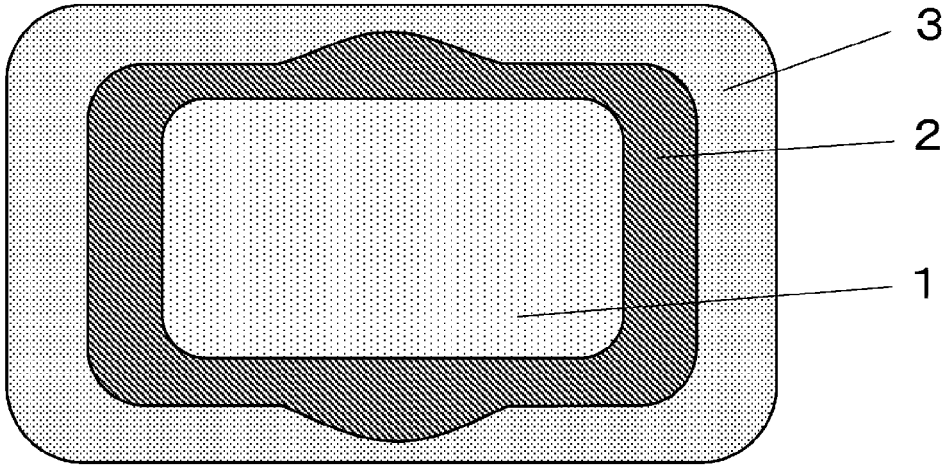
FIG. 9 is a schematic cross-sectional view of a laminated resin-coated insulated wire of the present invention having an enamel-baked layer on a rectangular conductor, in which a thick convex portion is set in the center of each of two long sides facing each other.

| | | CEx. 1 | CEx. 2 | CEx. 3 | CEx. 4 | CEx. 5 | CEx. 6 |
|---|---|---|---|---|---|---|---|
| Thermosetting resin layer (A) [enamel-baked layer] | Kind of resin | PAI | PI | PAI | PI | PI | PI |
| | Shape of coating resin layer | FIG. 5 Two convex portions on each of four sides | FIG. 5 Two convex portions on each of four sides | FIG. 7 One convex portion on one long side | FIG. 8 One convex portion on one short side | FIG. 6 No convex portion on each of four sides | FIG. 9 One convex portion on each of long sides facing each other |
| | Minimum film thickness | 39 | 25 | 38 | 38 | 45 | 38 |
| | Average of maximum film thicknesses of convex portion | 41 | 48 | 51 | 51 | 45 | 51 |
| | Minimum film thickness/Average of maximum film thicknesses of convex portion | 0.95 | 0.52 | 0.75 | 0.75 | 1.00 | 0.75 |
| Non-crystalline resin layer (C) [adhesion layer] | Kind of resin | — | PES | PEI | PEI | PEI | PEI |
| | Thickness | — | 7 | 6 | 6 | 7 | 7 |
| Thermoplastic resin layer (B) [extrusion-coated resin layer] | Kind of resin | TPI | PPS | PEEK | PEEK | PEEK | PEEK |
| | Thickness | 100 | 200 | 70 | 70 | 70 | 71 |
| Evaluation items of insulated wire | Workability | D | B | D | D | D | D |
| | Appearance | A | C | A | A | A | A |

"CEx." is an abbreviation of Comparative Example.

It is apparent from the above Tables 1 to 3 that Examples 1 to 16 in which regarding the thermosetting resin layer (A) [enamel-baked layer], all of two long sides and two short sides have convex portions and in all of them, the ratio of a minimum film thickness to an average of maximum film thicknesses of the convex portions is 0.60 or more and 0.90 or less, or at least a pair of two sides facing each other each have two convex portions and in any of the side having the convex portion the ratio of a minimum film thickness to an average of maximum film thicknesses of the convex portions is 0.60 or more and 0.90 or less, each exhibited an excellent adhesion property of the film in the workability evaluation and also are excellent in the appearance evaluation of all of surface of the insulated wire and the outer surface of the thermosetting resin layer (A) [enamel-baked layer], because all of the thermoplastic resin layer (B) [extrusion-coated resin layer] and the bare thermosetting resin layer (A) [enamel-baked layer] neither cause foam formation nor have a deficit at the surface thereof.

In addition, even if the thicknesses of the convex portion on the long side and the short side were different from one another as shown in Examples 11 to 14, and in addition, even if the thicknesses of the convex portion on the sides facing each other in two long sides and two short sides were different from one another as shown in Examples 15 and 16, excellent advantageous effects were achieved by satisfying the requirements of the present invention. Specifically, it is understood that if the requirements that all of two long sides and two short sides have convex portions and in all of these sides the ratio of minimum film thicknesses to an average of maximum film thicknesses of the convex portions is 0.60 or more and 0.90 or less, or at least two long sides each have two convex portions at both edges thereof and in all of the long sides the ratio of minimum film thicknesses to an average of maximum film thicknesses of the convex portions is 0.60 or more and 0.90 or less, are satisfied, both workability and appearance are highly evaluated.

Further, from comparison among Examples 1 to 10, it is understood that regarding the thermosetting resin layer (A) [enamel-baked layer], the configuration that all of the four sides each have a convex portion is excellent in workability compared to the configuration that only two long sides each have a convex portion. Further, it is understood that if two long sides each have convex portions at both edges thereof and two short sides each have at least one convex portion, more advanced effects are achieved. Here, from comparison between Examples 8 and 9, it is also understood that the configuration that the two long sides each have convex portions at both edges thereof is more excellent in workability than the configuration that the two short sides each have convex portions at both edges thereof.

In contrast, in the case as shown in Comparative Example 5 where all of four sides are a flat side without a convex potion in the traditional way, or in the case as shown in Comparative Examples 3 and 4 where only one side of four sides has a convex portion, or moreover in the case as shown in Comparative Example 6 where although two long sides each have a convex portion, each of them has only one convex portion at the center thereof and none of the short sides has a convex portion, their workability is inferior.

However, even in the case where all of two long sides and two short sides each have one convex portion, if the ratio of a minimum film thickness to an average of maximum film thicknesses of the convex portions is a value of more than 0.90 as shown in Comparative Example 1, evaluation of appearance is satisfactory, but workability is inferior. On the other hand, if the ratio of a minimum film thickness to an average of a maximum film thickness of the convex portion is a value of less than 0.60 as shown in Comparative Example 2, workability is satisfactory, but evaluation of appearance is inferior. As a result, it is understood that in order to satisfy both appearance evaluation and workability evaluation, it is necessary to set the ratio of minimum film thicknesses to an average of maximum film thicknesses of the convex portions to the range of 0.60 or more and 9.0 or less.

Here, in Comparative Example 1, it is presumed that the target workability was not achieved, because adequate area of contact between the thermoplastic resin layer (B) [extrusion-coated resin layer] and the thermosetting resin layer (A) [enamel-baked layer] was not obtained. Further, in Comparative Example 2, based on such a fact that foam formation due to a residual solvent was observed on the outside surface of the thermosetting resin layer (A) [enamel-baked layer], it is presumed that a maximal film thickness portion of the convex portion on the thermosetting resin layer (A) [enamel-baked layer] was not sufficiently baked.

Further, in Comparative Examples 3 and 4, because only one convex portion was present on either one of the longer side and the shorter side of four sides of the rectangular wire, delamination did not occur at the side where the convex portion was formed, but delamination occurred at the side without the convex portion, so that film delamination occurred by a few number of twist. Further, in Comparative Example 6, it appears that by forming a convex portion at the center of each of two long sides, resistance to delamination of the side was increased, but in a short side having no convex portion, there was no or little improvement effect of resistance to delamination, so that its workability did not reach a target level.

From the results described above, the insulated wire of the present invention is preferably used for a coil, particularly electric/electronic equipments such as a motor coil.

Having described our invention as related to the present embodiments, it is our intention that the invention not be limited by any of the details of the description, unless otherwise specified, but rather be construed broadly within its spirit and scope as set out in the accompanying claims.

This application claims priority on Patent Application No. 2013-270576 filed in Japan on Dec. 26, 2013, which is entirely herein incorporated by reference.

REFERENCE SIGNS LIST

1 Conductor
2 Enamel-baked layer (thermosetting resin layer)
3 Extrusion-coated resin layer (thermoplastic resin layer)

The invention claimed is:

1. An insulated wire comprising a laminated resin-coated insulated wire comprising:

a thermosetting resin layer (A) directly or via an insulating layer (D) on a conductor having a rectangular cross-section; and at least a thermoplastic resin layer (B) on the outer periphery of the thermosetting resin layer (A), wherein the cross-sectional shape of the thermosetting resin layer (A) composed of two pairs of two sides facing each other, and has at least four convex portions each of which has a film thickness in maximum, wherein at least one convex portion of the at least four convex portions is on each of the four sides, or at least two convex portions of the at least four convex portions are on at least two sides facing each other, and wherein, in the each side having the convex portion, provided that a minimum film thickness is designated as "a" μm, and an average of maximum film thicknesses of the convex portions is designated as "b" μm, the a/b ratio is 0.60 or more and 0.90 or less.

2. The insulated wire according to claim 1, wherein the cross-sectional shape of the thermosetting resin layer (A) at least has at least two of the convex portions on each of the two sides facing each other, and has one or at least two of the convex portions on each of the other two sides facing each other, and wherein, in the each side having the convex portion, provided that a minimum film thickness is designated as "a" μm, and an average of maximum film thicknesses of the convex portions is designated as "b" μm, the a/b ratio is 0.60 or more and 0.90 or less.

3. The insulated wire according to claim 1, wherein the cross-sectional shape of the thermosetting resin layer (A) has one of the convex portions on the each of four sides.

4. The insulated wire described according to claim 1, wherein, in the case of having one of the convex portions on one side, the cross-sectional shape of the thermosetting resin layer (A) has one of the convex portions in the vicinity of the center of the one side, or, in the case of having at least two of the convex portions on one side, the cross-sectional shape of the thermosetting resin layer (A) has one of the convex portions in the vicinity of each of both edges of the one side, or has one of the convex portions in the area ranging from a halfway point between the center and an edge of the one side to the edge thereof and another one of the convex portions in the area ranging from the other halfway point between the center and the other edge of the one side to the other edge.

5. The insulated wire according to claim 1, wherein, in the cross-sectional shape of the laminated resin coat, the cross-sectional outer shape of the thermoplastic resin layer (B) composed of two long sides facing each other and two short sides facing each other, and in each side, any portion of said side is the same in a total thickness of the laminated resin-coated layers up to the conductor.

6. The insulated wire according to claim 1, comprising an insulating layer (C) composed of a non-crystalline resin between the thermosetting resin layer (A) and the thermoplastic resin layer (B).

7. The insulated wire according to claim 6, wherein the non-crystalline resin is a resin selected from the group consisting of a polyetherimide, a polyethersulfone, a polyphenylsulfone, and a polyphenyleneether.

8. The insulated wire according to claim 1, wherein a resin constituting the thermoplastic resin layer (B) is a thermoplastic resin selected from the group consisting of a thermoplastic polyimide, a polyphenylenesulfide, a polyetheretherketone, and a modified polyetheretherketone.

9. The insulated wire according to claim 1, wherein a resin constituting the thermosetting resin layer (A) is a thermosetting resin selected from the group consisting of a polyimide, a polyamideimide, a thermosetting polyester, and a Class H polyester.

10. A coil produced by processing the insulated wire according to claim 1 by winding.

11. An electric/electronic equipment, comprising the coil according to claim 10.

12. A method of producing a film delamination-resistant insulated wire composed of a laminated resin-coated insulated wire having a thermosetting resin layer (A) directly or via an insulating layer (D) on a conductor having a rectangular cross-section, and having at least a thermoplastic resin layer (B) on the outer periphery of the thermosetting resin layer (A), wherein the cross-sectional shape of the thermosetting resin layer (A) includes two pairs of two sides facing each other, and has at least four convex portions each of which has a film thickness in maximum, which comprises the step of:

forming said at least four convex portions by forming at least one convex portion on each of the four sides, or by forming at least two convex portions on each of at least the two sides facing each other to satisfy the a/b ratio of 0.60 or more and 0.90 or less, thereby preventing an occurrence of delamination of the thermoplastic resin layer (B) from the conductor of the insulated wire, provided that in the each side having the convex portion, a minimum film thickness is designated as "a" μm, and an average of maximum film thicknesses of the convex portions is designated as "b" μm.

* * * * *